US011464307B2

(12) United States Patent
Bloom

(10) Patent No.: US 11,464,307 B2
(45) Date of Patent: Oct. 11, 2022

(54) HAND BAG WITH INTEGRATED FINGERPRINT LOCK AND ZIPPER AND/OR FLAP CLOSURE

(71) Applicant: Rachel Bloom, Kettering, OH (US)

(72) Inventor: Rachel Bloom, Kettering, OH (US)

( * ) Notice: Subject to any disclaimer, the term of this patent is extended or adjusted under 35 U.S.C. 154(b) by 485 days.

(21) Appl. No.: 16/241,313

(22) Filed: Jan. 7, 2019

(65) Prior Publication Data

US 2020/0100574 A1 Apr. 2, 2020

Related U.S. Application Data

(63) Continuation-in-part of application No. 29/671,327, filed on Nov. 26, 2018, and a continuation-in-part of application No. 29/665,253, filed on Oct. 1, 2018, now Pat. No. Des. 863,758.

(51) Int. Cl.

| | |
|---|---|
| ***A45C 13/18*** | (2006.01) |
| ***A45C 3/06*** | (2006.01) |
| ***A45C 13/10*** | (2006.01) |
| ***G07C 9/00*** | (2020.01) |
| ***E05B 65/52*** | (2006.01) |
| ***E05B 47/00*** | (2006.01) |
| ***A45C 3/00*** | (2006.01) |

(52) U.S. Cl.

CPC ..... *A45C 13/18* (2013.01); *A45C 3/001* (2013.01); *A45C 3/06* (2013.01); *A45C 13/103* (2013.01); *E05B 47/0001* (2013.01); *E05B 65/5284* (2013.01); *G07C 9/00563* (2013.01)

(58) Field of Classification Search

CPC ..... A45C 13/18; A45C 13/103; E05B 65/48

USPC ..... 70/68

See application file for complete search history.

(56) References Cited

U.S. PATENT DOCUMENTS

| | | | |
|---|---|---|---|
| 698,067 | A | 4/1902 | Smith |
| 2,822,013 | A | 2/1958 | Renz |
| D285,868 | S | 9/1986 | Davis et al. |
| 4,913,283 | A | 4/1990 | Stuhn |
| 5,138,468 | A | 8/1992 | Baebanell |
| D383,492 | S | 9/1997 | Semon et al. |
| D407,432 | S | 3/1999 | Tell |
| 5,963,657 | A | 10/1999 | Bowker et al. |
| D422,411 | S | 4/2000 | Martin |
| 6,374,652 | B1 | 4/2002 | Hwang |
| 6,401,501 | B1 | 6/2002 | Kajuch et al. |
| D469,952 | S | 2/2003 | Daglow et al. |
| D492,485 | S | 7/2004 | Domotor et al. |
| 6,865,913 | B2 | 3/2005 | Yamagishi |
| 7,043,060 | B2 | 5/2006 | Quintana |
| D576,403 | S | 9/2008 | Leslie et al. |
| D584,895 | S | 1/2009 | Holzner et al. |
| D615,296 | S | 5/2010 | Bassee |
| D651,393 | S | 1/2012 | Coleman |

(Continued)

FOREIGN PATENT DOCUMENTS

| | | | | |
|---|---|---|---|---|
| CN | 200990955 | Y * | 12/2007 | ..... A45C 13/18 |
| CN | 101354798 | A | 1/2009 | |

(Continued)

*Primary Examiner* — John K Fristoe, Jr.
*Assistant Examiner* — Justin Caudill
(74) *Attorney, Agent, or Firm* — Thomas E. Lees, LLC

(57) ABSTRACT

A hand bag having providing an open top has a zipper for closing the open top and has a tab for connecting to a fingerprint lock mounted on the hand bag.

4 Claims, 16 Drawing Sheets

(56) References Cited

U.S. PATENT DOCUMENTS

| | | | | |
|---|---|---|---|---|
| D691,584 | S | 10/2013 | Nussbaum et al. | |
| D694,002 | S | 11/2013 | Bland | |
| D733,978 | S | 7/2015 | Bayless | |
| D742,631 | S | 11/2015 | Kim | |
| D748,909 | S | 2/2016 | Wronski et al. | |
| D771,373 | S | 11/2016 | Kim | |
| 9,512,647 | B2 * | 12/2016 | Meersschaert | E05B 37/0048 |
| 9,770,084 | B1 * | 9/2017 | Shiekh | A45C 15/00 |
| D809,788 | S | 2/2018 | Fusi | |
| D815,431 | S | 4/2018 | Fusi | |
| D820,588 | S | 6/2018 | Nair | |
| D834,311 | S | 11/2018 | Tomasetta | |
| D841,318 | S | 2/2019 | Carter et al. | |
| D844,323 | S | 4/2019 | Shuai et al. | |
| D847,494 | S | 5/2019 | Tang | |
| D853,717 | S | 7/2019 | Shuai et al. | |
| D856,677 | S | 8/2019 | Gill et al. | |
| D866,956 | S | 11/2019 | Wu | |
| D867,750 | S | 11/2019 | Warren | |
| D869,149 | S | 12/2019 | Okungbaiye | |
| 11,019,888 | B2 * | 6/2021 | Newson | A45C 13/18 |
| 2002/0034321 | A1 | 3/2002 | Saito | |
| 2004/0025550 | A1 | 2/2004 | Yamagashi | |
| 2004/0066366 | A1 * | 4/2004 | Jung | A45C 15/00 345/156 |
| 2004/0255623 | A1 | 12/2004 | Sun et al. | |
| 2008/0012686 | A1 | 1/2008 | Bonestroo | |
| 2009/0226050 | A1 * | 9/2009 | Hughes | G08B 21/0208 382/124 |
| 2011/0186397 | A1 * | 8/2011 | Sheikh | A45C 13/18 190/120 |
| 2011/0214787 | A1 * | 9/2011 | Schulte | A45C 13/26 150/102 |
| 2016/0360351 | A1 | 12/2016 | Cabouli | |
| 2017/0198497 | A1 | 6/2017 | Tsai | |
| 2018/0279735 | A1 * | 10/2018 | Paul | A45C 5/03 |
| 2018/0371794 | A1 * | 12/2018 | Zhang | E05B 65/52 |

FOREIGN PATENT DOCUMENTS

| | | | | | |
|---|---|---|---|---|---|
| CN | 201806072 | U | | 4/2011 | |
| CN | 102783781 | | | 11/2012 | |
| CN | 203789324 | U | * | 8/2014 | A45C 13/24 |
| CN | 203835066 | U | * | 9/2014 | A45C 13/00 |
| CN | 106917550 | | | 7/2017 | |
| CN | 108078133 | A | * | 5/2018 | A45C 13/103 |
| DE | 102012108192 | A1 | * | 3/2014 | A45C 13/103 |
| EP | 3239441 | A1 | * | 11/2017 | A44B 19/30 |
| GB | 2458889 | | | 7/2009 | |
| GB | 2547913 | A | | 6/2017 | |
| GB | 2531937 | | | 11/2017 | |
| WO | WO2007101292 | | | 9/2007 | |
| WO | WO2015121630 | | | 8/2015 | |
| WO | WO-2017109418 | A1 | * | 12/2015 | A45C 13/18 |

* cited by examiner 72
26
74
40
10

24
10

HAND BAG WITH INTEGRATED FINGERPRINT LOCK AND ZIPPER AND/OR FLAP CLOSURE

FIELD OF INVENTION

The instant invention relates to an improvement in hand bag designs. More particularly, the instant invention relates to a hand bag, such a purse, wallet, tote, clutch, concealment bag, or wallet, for example, having an improved locking structure.

BACKGROUND OF INVENTION

The prior art includes various types of bags with locking mechanisms. More recently, these bags have included biometric features. One such prior example is CN201806072 directed to a wallet with fingerprint identification technique to prevent the theft wherein the wallet comprises a wallet purse body, an opening of the body is provided with an electronic wallet lock, the electronic lock connected to a controller, the controller connected to fingerprint lock and a buzzer and power source. The battery is a button battery. When the wallet is opened if the authorized fingerprint is not met, then an alarm sounds.

SUMMARY OF THE INVENTION

It is an object to improve on the design of fingerprint lock bags.

An object is to improve on antitheft hand bag design.

Accordingly, one embodiment of the invention is directed to a hand bag having a bottom, sides connected to and extending from the bottom to provide forming a container with an open top. A zipper connects to the open top in a manner to enable closure of the top. The zipper has an end pull tab with a locking loop extending therefrom.

In another embodiment, one of the sides can preferably include an elongated upper end forming a flap which can fold over the open top and lay over a front face of an opposing side. The flap includes a tab with a locking loop extending inwardly toward the face of the opposing side.

Integrally connected to the hand bag is a fingerprint lock having a housing with a front plate having a first opening for exposing a fingerprint identifying pad operably disposed in the housing and a second opening for receiving the locking loop therethrough, a power operated locking mechanism having a moving pin operably disposed in the housing which actuates the pin between a closed position below the second opening to lock the locking loop and an open position sufficiently disposed with respect to the second opening to not retain the locking loop when inserted through the second opening. A battery is operably disposed in the housing and connected to the powered operated locking mechanism.

The front plate has a back side formed with a plurality of threaded apertures and the housing has a complementary number of apertures through which mounting screws are inserted in a manner and through the housing on an inner side of the hand bag and through the hand bag to securely connect to the threaded apertures of the front plate to sandwich about a portion of the hang bag and secure the lock in place such that when the zipper fully closes the open top, the locking loop may be inserted into the second opening to enable the pin to move therethrough and lock the zipper in a closed position.

A controller is operably disposed in the housing and connected to the fingerprint pad and power operated locking mechanism for closing the opening and closing the pin based on a preprogrammed fingerprint identification being met. The handbag can preferably include a cut-proof material.

DETAILED DESCRIPTION OF THE INVENTION

Figure 1:
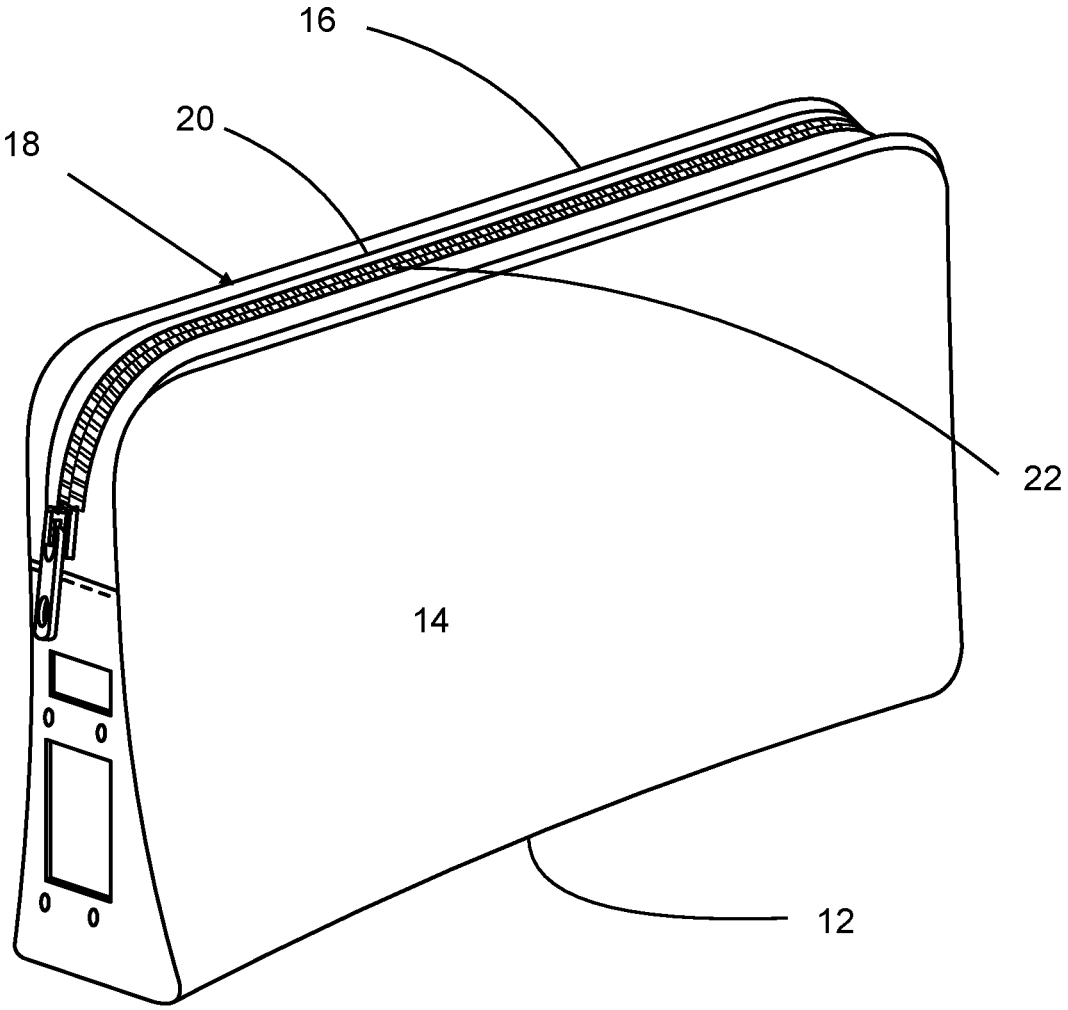
FIG. 1 is a front perspective view of a part of the hand bag of the invention.
Figure 2:
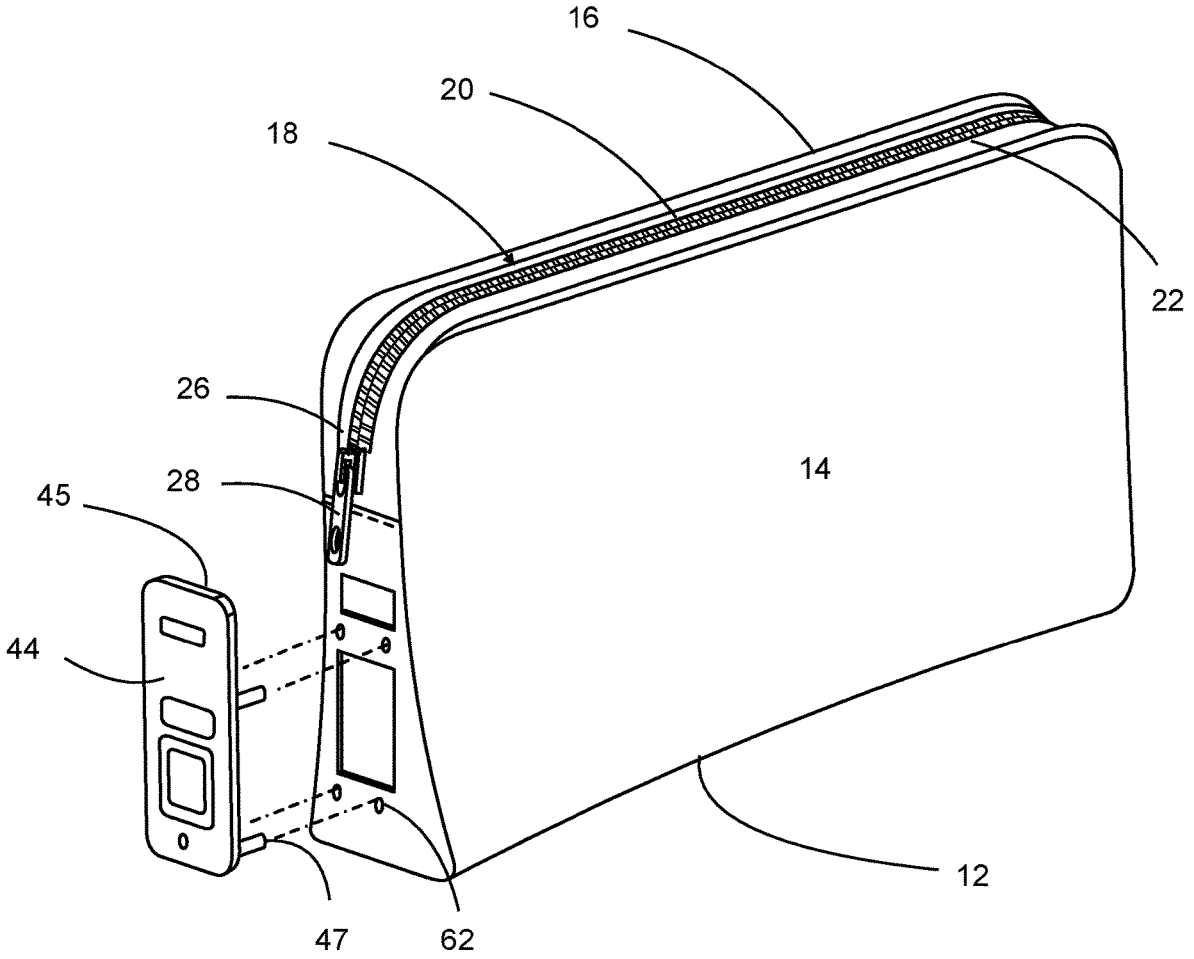
FIG. 2 is another front perspective view with a lock in exploded relation to the hand bag in FIG. 1.
Figure 3:
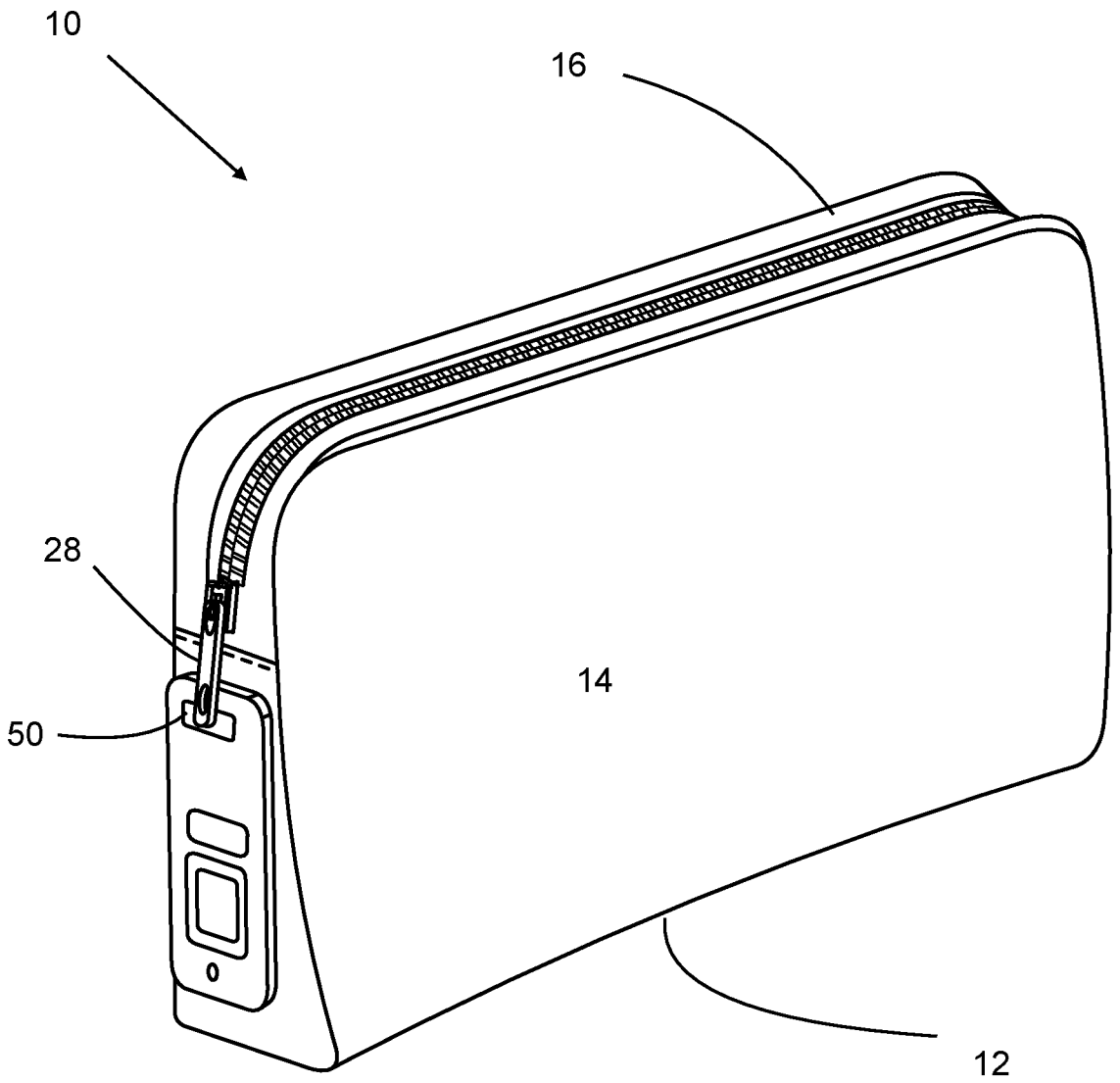
FIG. 3 is a front perspective view of an assembled embodiment of the invention.
Figure 4:
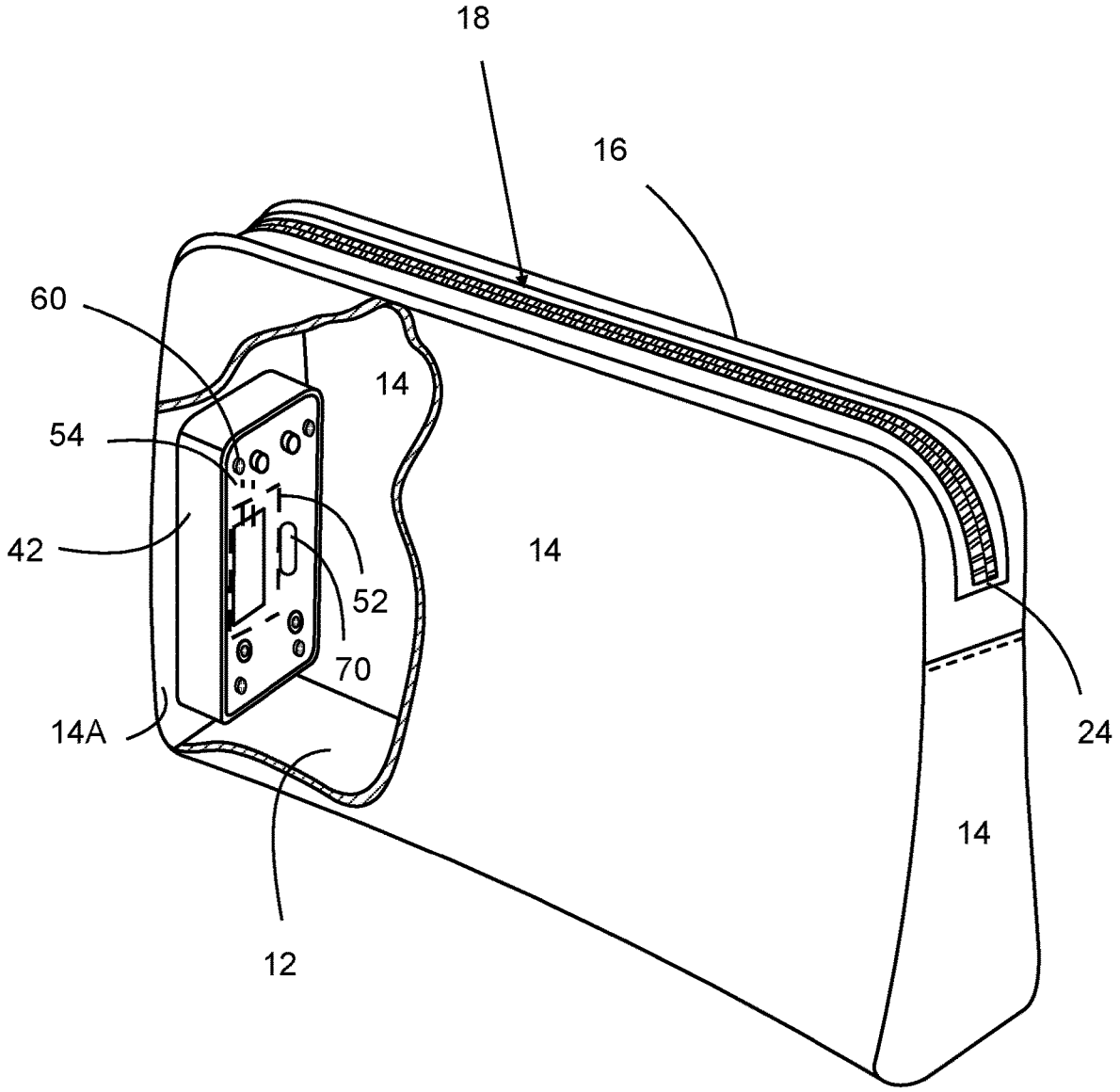
FIG. 4 is a cut-away back perspective illustrating a housing part of the lock inside a hand bag of FIG. 1.
Figure 5:
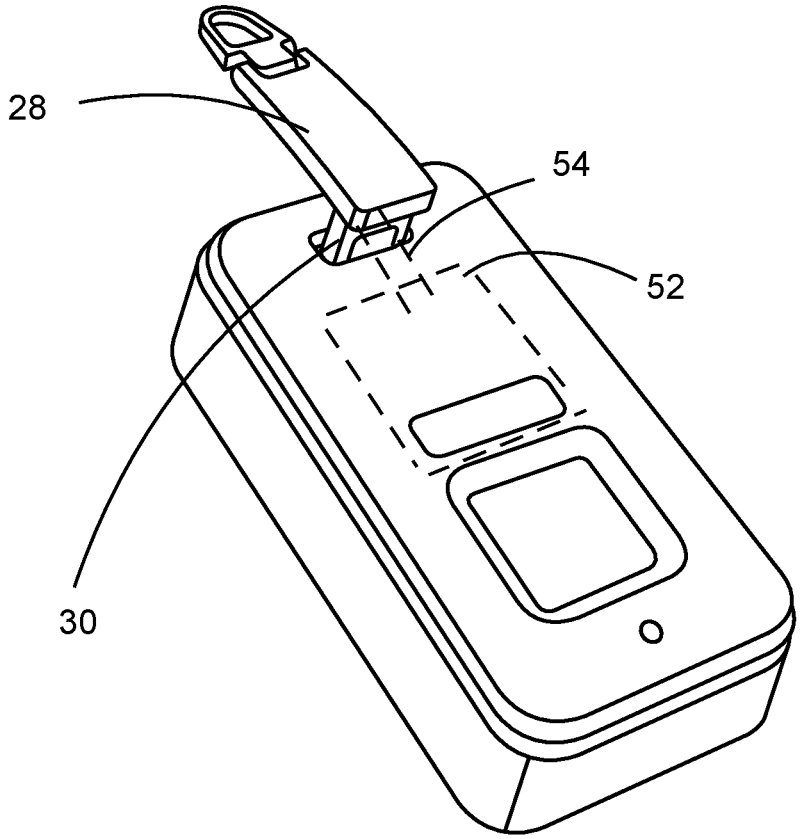
FIG. 5 is a top perspective view of a fingerprint lock of the invention in a locked mode.
Figure 6:
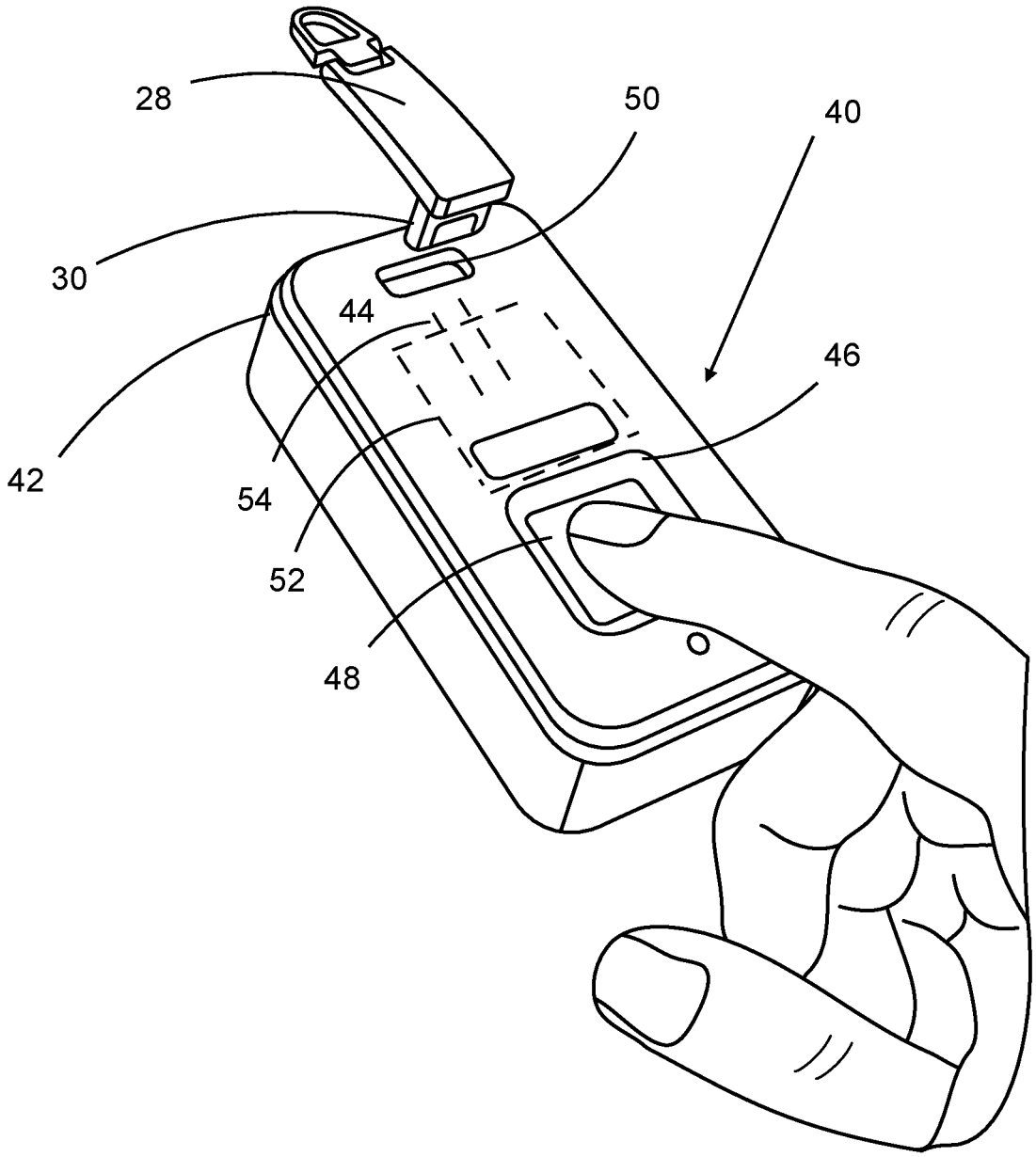
FIG. 6 is a top perspective view of a fingerprint lock of the invention in an unlocked mode.

Referring now to the drawings, the hand bag with integrated fingerprint lock and zipper is generally referred by the numeral 10, where like parts are referenced with like numerals. The hand bag 10 has a bottom 12, sides 14, wherein it is contemplated that the side 14 could be connectively one or more piece(s), which connect to and extending from the bottom 12. The sides 14 and interconnect to each other and provide an open top 16. A zipper 18 connects to the open top 16 in a manner to enable closure of the top 16. The zipper 18 has two mating portions 20 and 22, a fixed end 24 and an openable end 26. A pull tab 28 is provided on zipper 18 for opening and closing the two mating portions 20 and 22 and has a locking loop 30 extending therefrom.

In another embodiment, one of the sides 14B can preferably include an elongated upper end 14B' forming a flap which can fold over the open top 16 and lay over a front face of an opposing side 14C. The flap 14B' includes tab 28' with a locking loop extending inwardly toward the face of the opposing side 14C.

Integrally connected to the hand bag 10 is a fingerprint lock 40 having a housing 42 with a removable front plate 44. The front plate 44 has a first opening 46 for exposing a fingerprint identifying pad 48 operably disposed in the housing 42 and a second opening 50 for receiving the locking loop 30 of the pull tab 28 therethrough. A power operated locking mechanism 52 has a moving pin 54 operably disposed in the housing 42 which actuates the pin 54 between a closed position below the second opening 50 to lock the locking loop 30 and an open position sufficiently disposed with respect to the second opening 50 to not retain the locking loop 30 when inserted through the second opening 50. A battery 56 is operably disposed in the housing 42 and connected to the powered operated mechanism 52.

The front plate 44 has a back side 45 formed with a plurality of threaded apertures 47 and the housing 24 has a complementary number of apertures 25 through which mounting screws 60 are inserted in a manner and through the housing 42 on an inner surface of side 14A of the hand bag 10 and through respective holes 62 of the hand bag 10 to securely connect to the threaded apertures 47 of the front plate 44 to sandwich about a portion of side 14A of the hang bag 10 and secure the lock 40 in place. The lock 40 is disposed on the hand bag 40 such that when the zipper 18 fully closes the open top 16, the locking loop 30 of tab 28 may be inserted into the second opening 50 to enable the pin 54 to move therethrough and lock the zipper 18 in a closed position.

Figure 7:
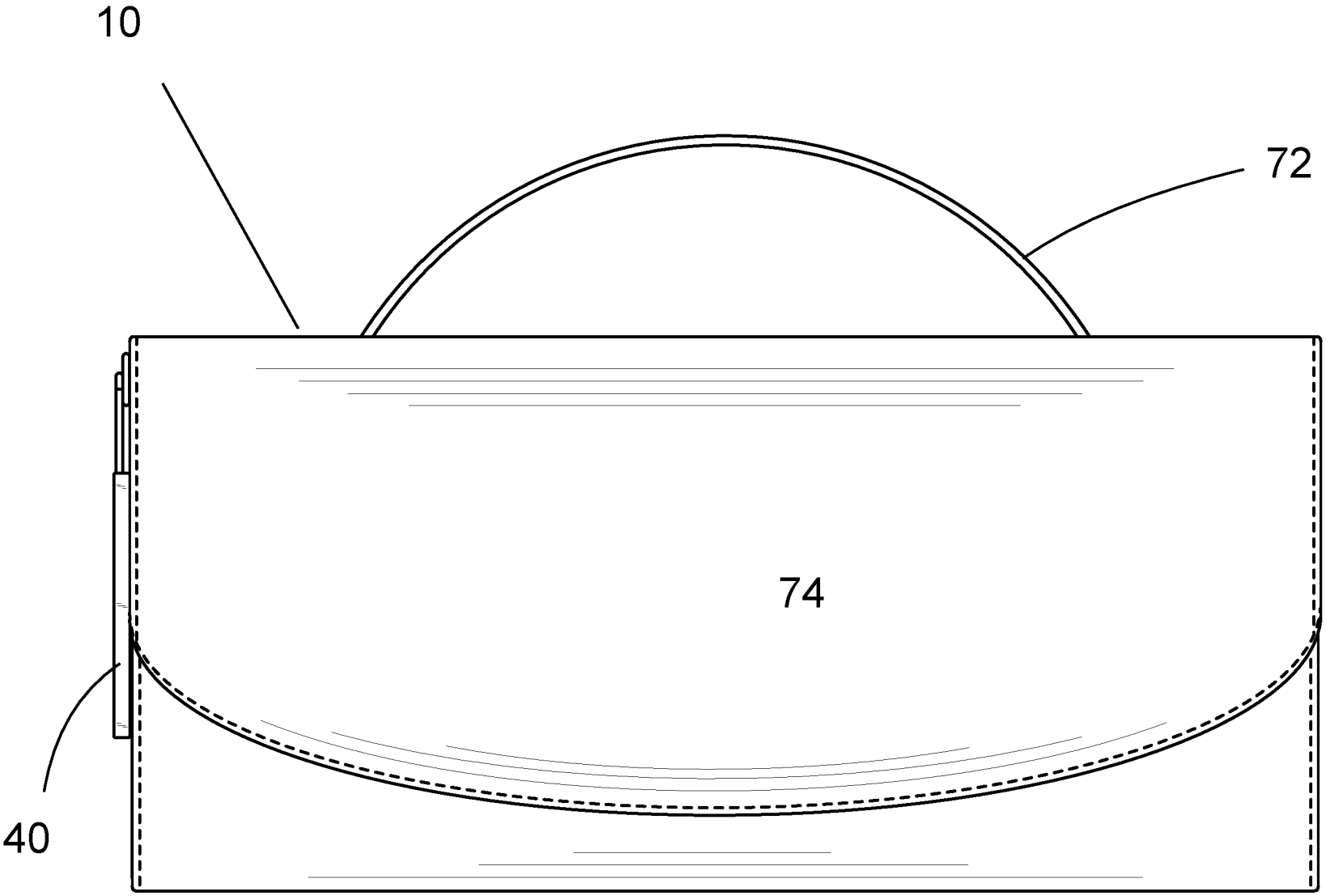
FIG. 7 illustrates front perspective of another embodiment of the invention.
Figure 8:
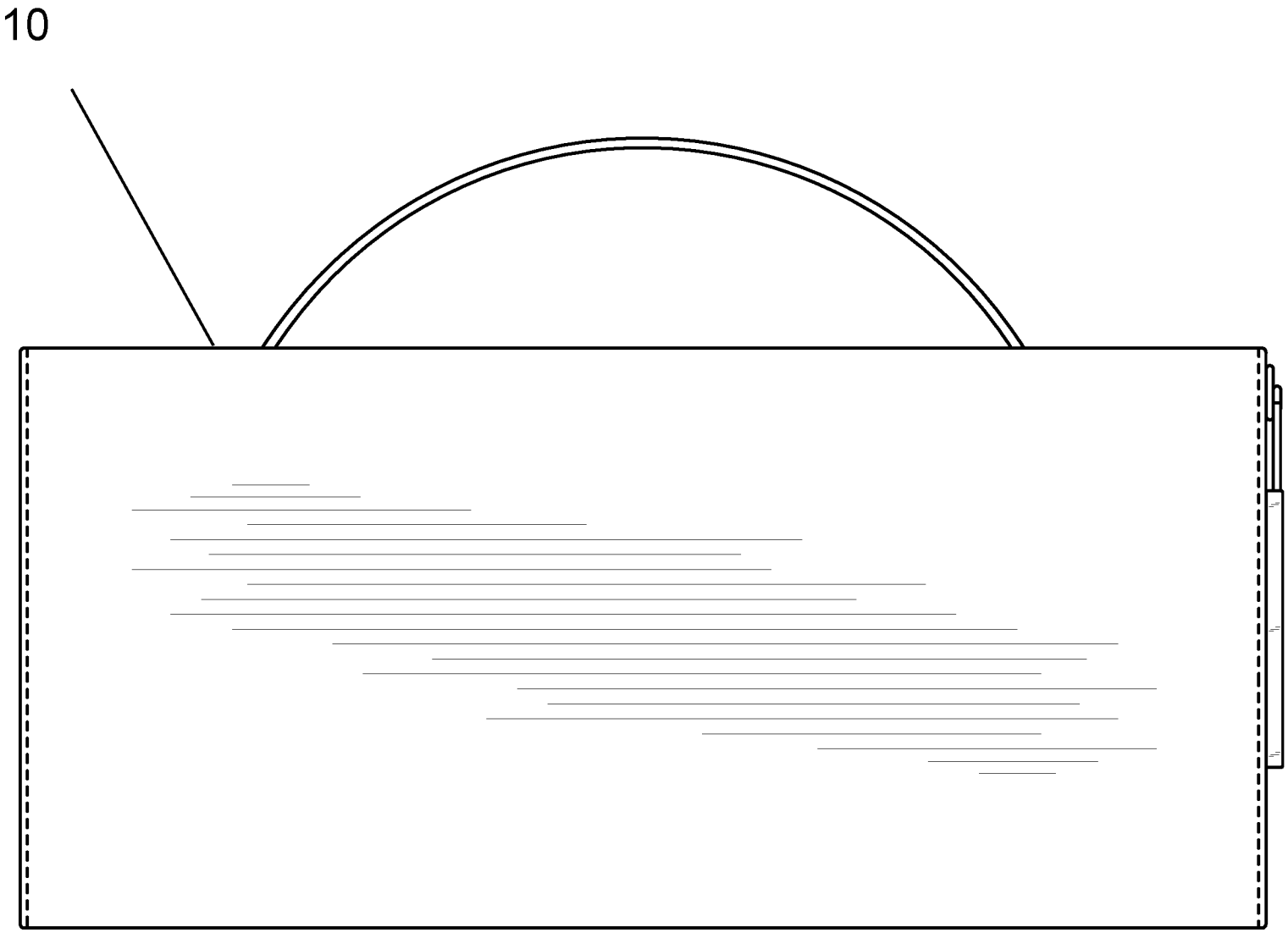
FIG. 8 is a back view of the embodiment in FIG. 7.
Figure 9:
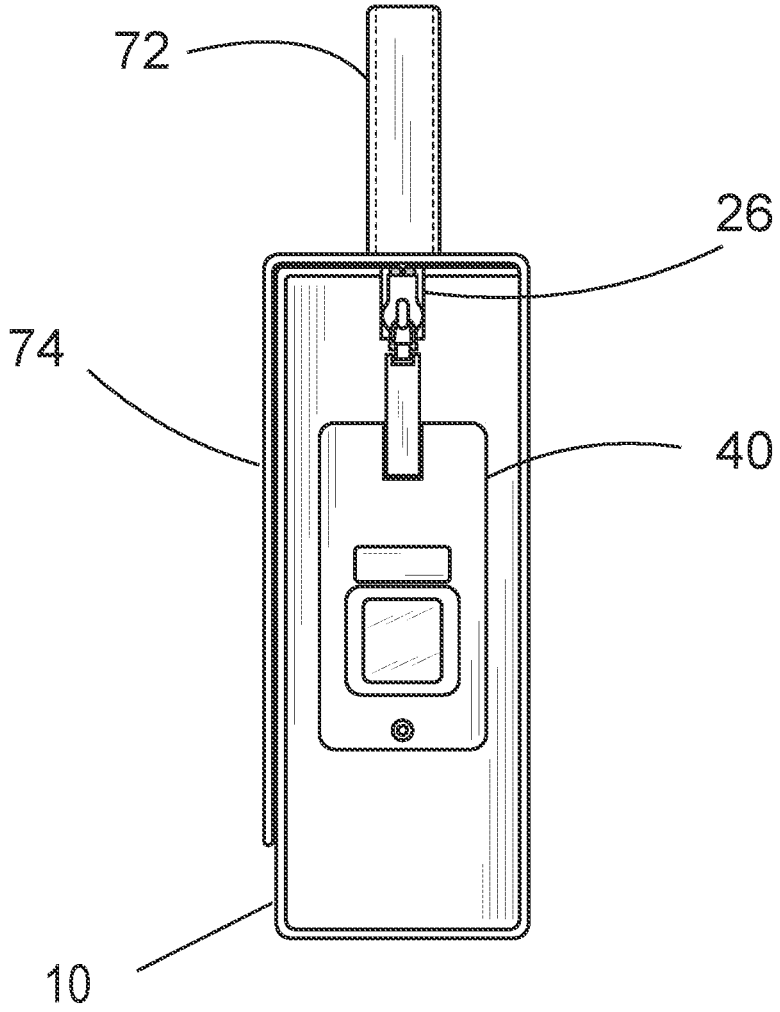
FIG. 9 is a right side elevation end view of the embodiment in FIG. 7.
Figure 10:
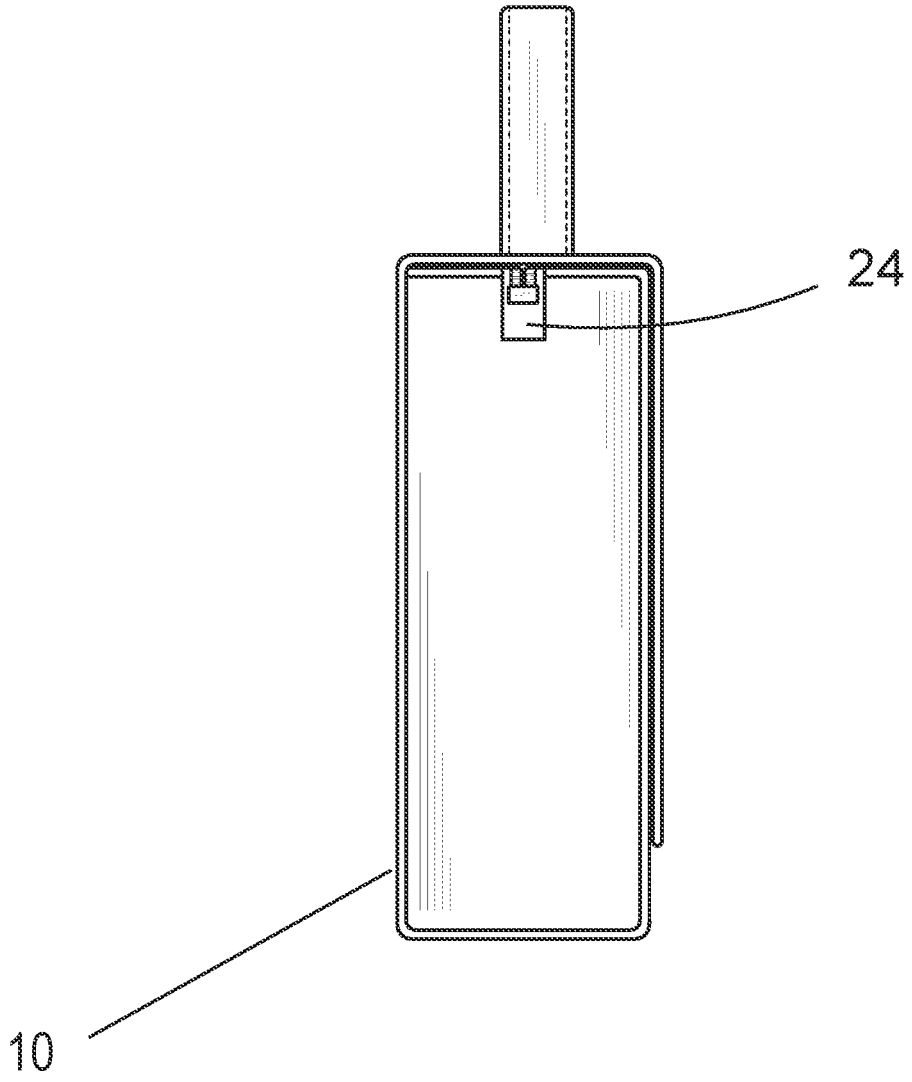
FIG. 10 is a left side of the embodiment in FIG. 7.
Figure 11:
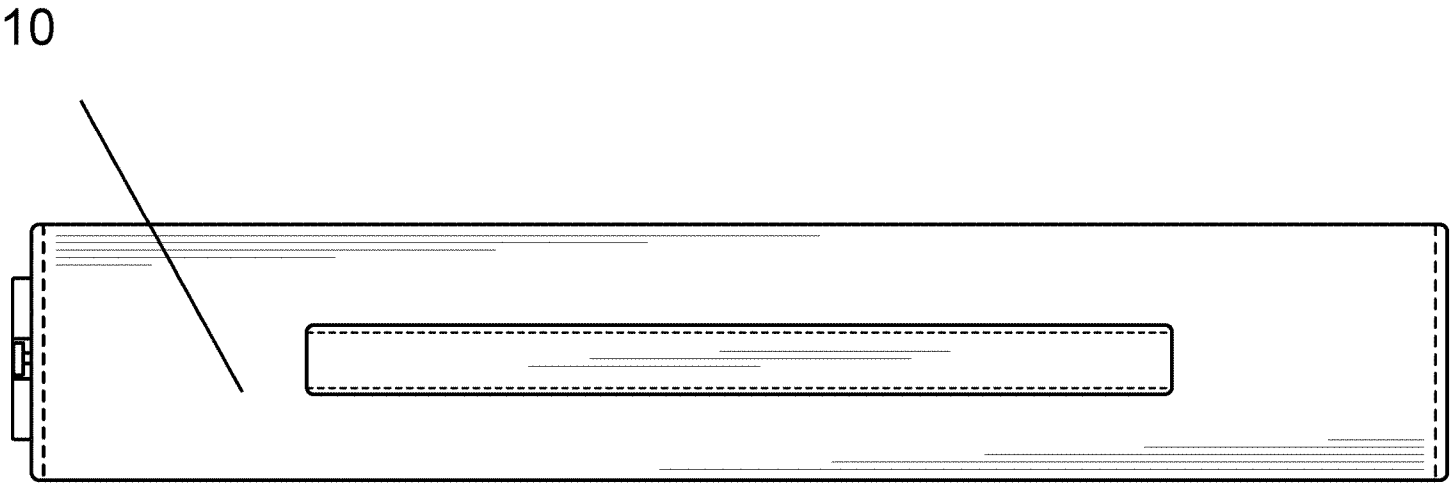
FIG. 11 is a top view of the embodiment in FIG. 7.
Figure 12:
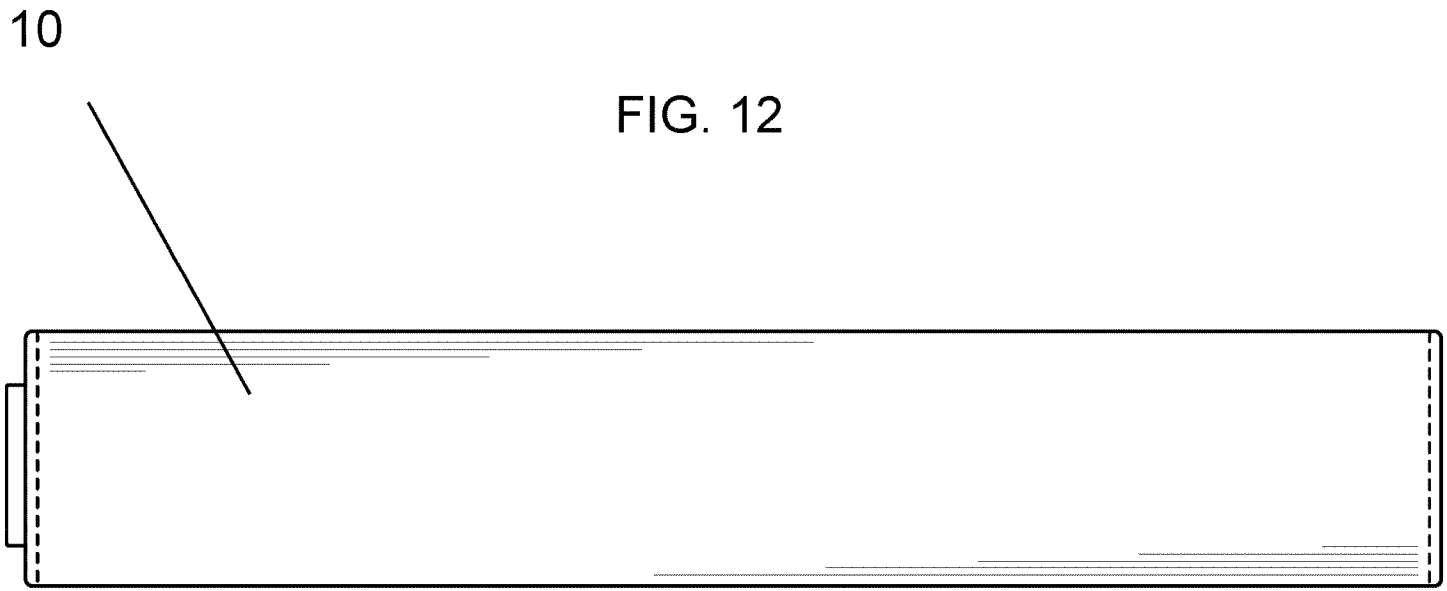
FIG. 12 is a bottom view of the embodiment in FIG. 7.
Figure 13:
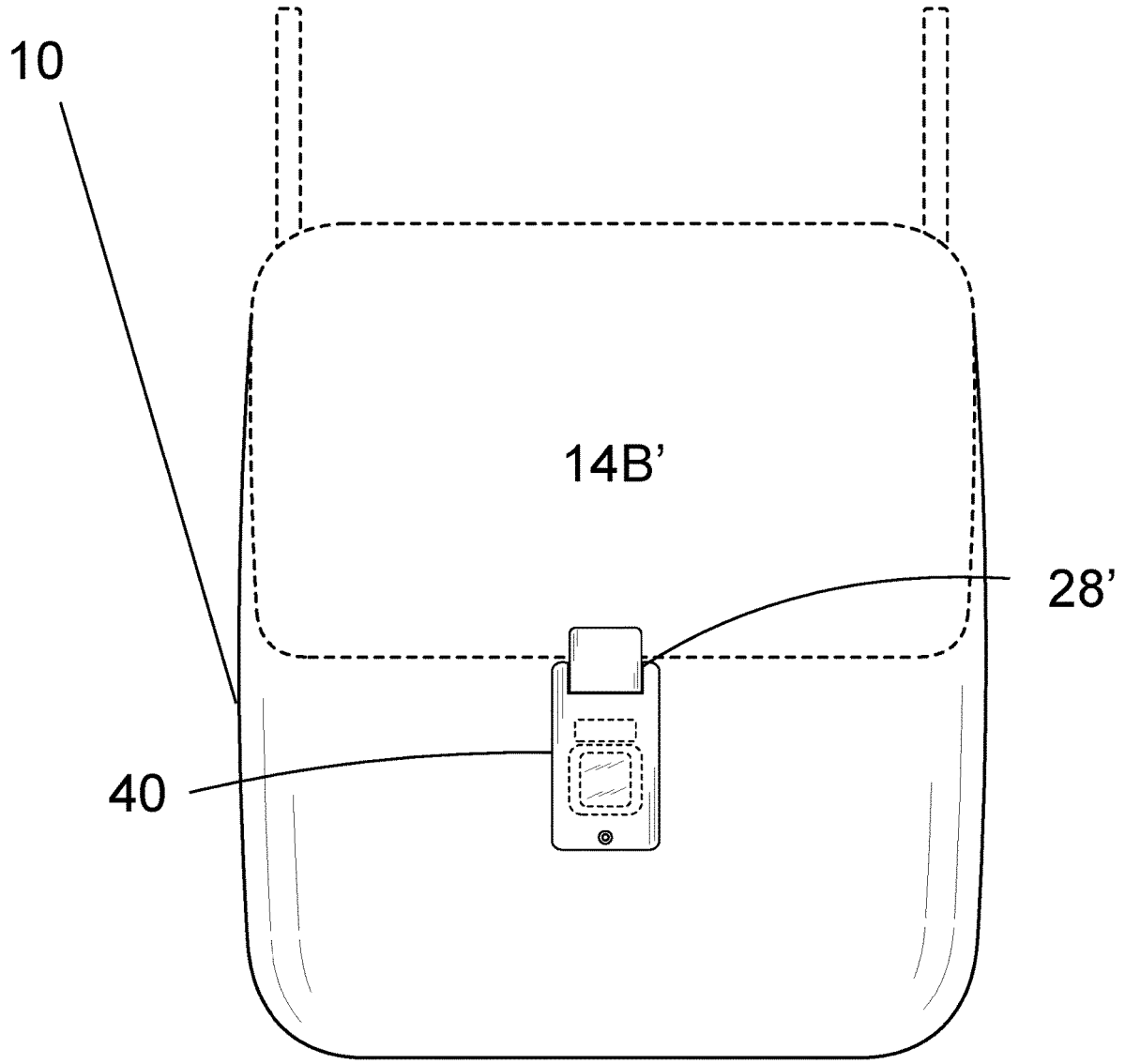
FIG. 13 illustrates front perspective of still another embodiment of the invention.
Figure 14:
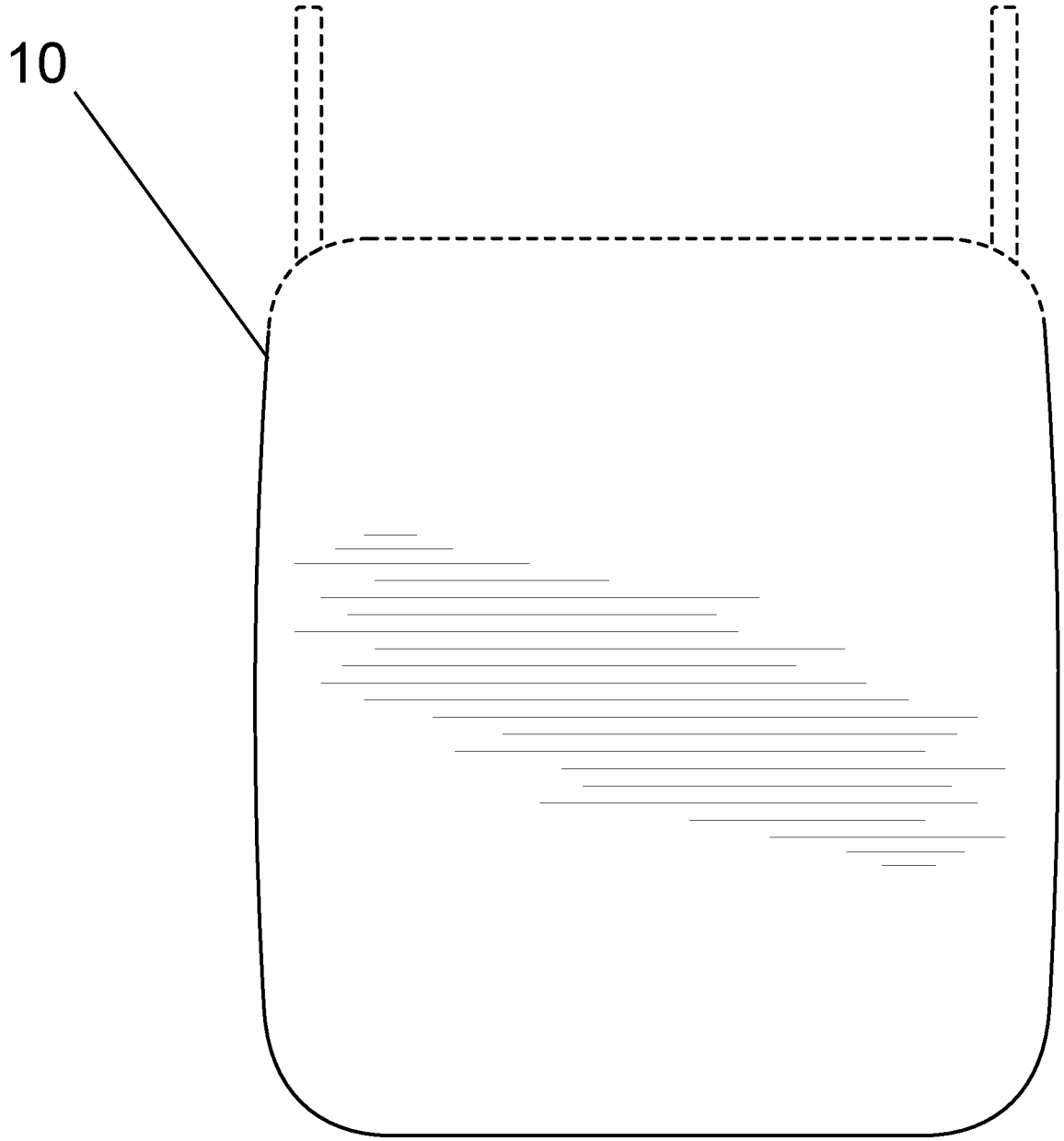
FIG. 14 is a back view of the embodiment in FIG. 13.
Figure 15:
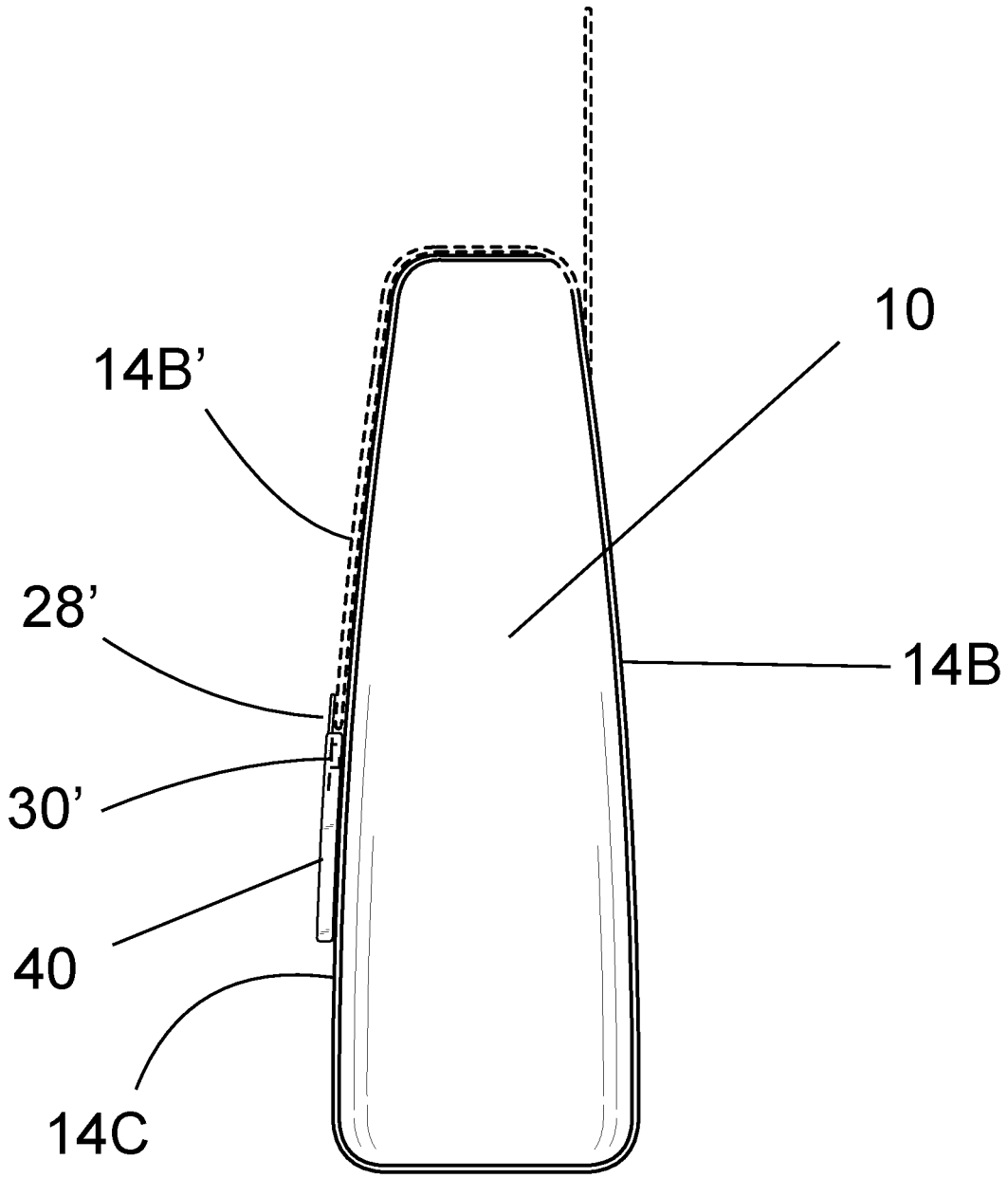
FIG. 15 is a right side elevation end view of the embodiment in FIG. 13.
Figure 16:
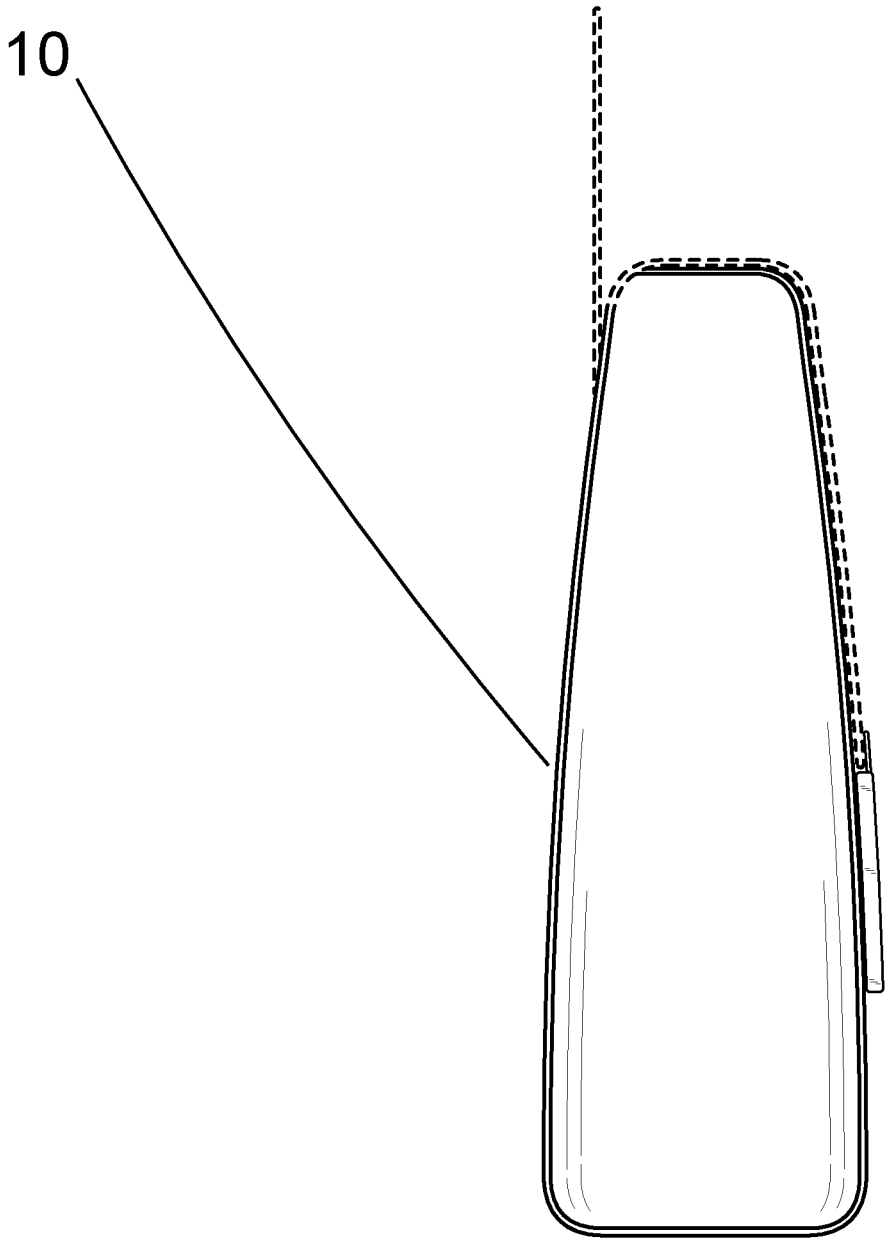
FIG. 16 is a left side of the embodiment in FIG. 13.
Figure 17:
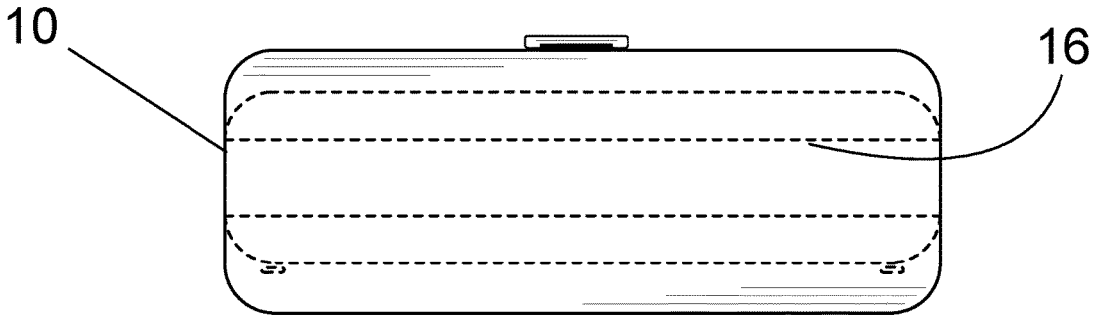
FIG. 17 is a top view of the embodiment in FIG. 13.
Figure 18:
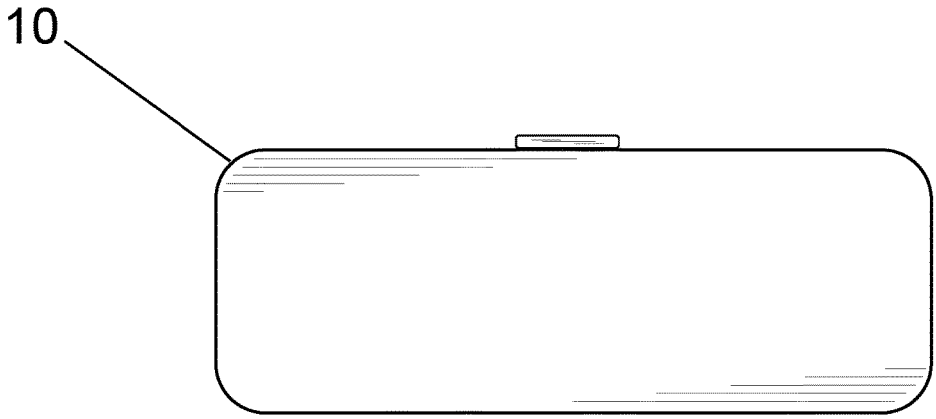
FIG. 18 is a bottom view of the embodiment in FIG. 13.

A controller 70 is operably disposed in the housing 42 and connected to the fingerprint pad 48 and power operated mechanism 52 for closing the opening and closing the pin 54 based on a preprogrammed fingerprint identification being met. A battery 56 is operably disposed in the housing 42 and connected to the controller 70 and powered operated mechanism 52. As seen in the embodiment seen in FIG. 7, the hand bag 10 can include a carrying strap 72 and a flap 74 covering the zipper 18, which could be several as seen in FIG. 13.

The handbag 10 can preferably include a cut-proof material. The instant claims are not to be overly limited by the above description. Rather, the claims appended hereto should be given the scope of protection to cover those modifications, improvements and derivations readily apparent to those skilled in the art.

The invention claimed is:

1. A hand bag with a fingerprint lock, comprising:

a bottom and a plurality of sides that together define a container with an open top, wherein the plurality of sides comprise a pair of major sides opposite one another and a pair of minor sides opposite one another and substantially orthogonal to the pair of major sides, the plurality of sides connected to and extending from the bottom and interconnecting to provide the container with the open top, further wherein at least a portion of the handbag is defined by a cut-proof material;

a zipper connecting to said open top in a manner to enable closure of said top, said zipper extending from a fixed end that is situated on one of the minor sides to an openable end that is situated on the other of the minor sides and having an end pull tab with a locking loop extending orthogonally therefrom and that defines an aperture therein that is parallel to a major length of the pull tab;

a fingerprint lock integrally connected to the container through the other of the minor sides of such that the lock is integrated into the hand bag through the other of the minor sides adjacent a terminus point of the openable end, the fingerprint lock having a housing with a removable front plate having a first opening for exposing a fingerprint identifying pad operably disposed in said housing and a second opening for receiving said locking loop of said pull tab therethrough, a power operated mechanism having a moving pin operably disposed in said housing which actuates said pin between a closed position below said second opening to lock said locking loop through engagement between said pin and said aperture and an open position sufficiently disposed with respect to said second opening to not retain said locking loop when inserted through said second opening; and a controller is operably disposed in said housing and connected to said fingerprint pad and power operated mechanism for closing said opening and closing said pin based on a preprogrammed fingerprint identification being met, where a width profile defined by the housing of the fingerprint lock is sized such that it occupies a substantial majority of the dimension of the other of the minor sides.

2. The hand bag of claim 1, wherein said removable front plate has a back side formed with a plurality of threaded apertures and said housing has a complementary number of apertures through which mounting screws are inserted in a manner and through said housing on an inner side of said hand bag and through the cut-proof material of said hand bag to securely connect to said threaded apertures of said front plate to sandwich about a portion of said hang bag and secure the lock in place such that when said zipper fully closes said open top, said locking loop may be inserted into said second opening to enable said pin to move therethrough and lock said zipper in a closed position.

3. The handbag of claim 1, which further includes a carrying strap connected thereto.

4. A hand bag with a fingerprint lock, comprising:

a container comprising a bottom and a plurality of sides all of which are made from a cut-proof material and connected together to define an open top within the container, wherein the plurality of sides comprise a pair of major sides opposite one another and a pair of minor sides opposite one another and substantially orthogonal to the pair of major sides;

a zipper connected to the plurality of sides in order to provide selective closure of the open top, the zipper extending from a fixed end that is situated on a first of the minor sides to an openable end that is situated on a second of the minor sides and having an end pull tab with a locking loop extending orthogonally therefrom, the locking loop defining an aperture therein that is parallel to a major length of the pull tab;

a fingerprint lock integrally connected to the container through the second of the minor sides of such that the lock is integrated into the hand bag through the second of the minor sides adjacent a terminus point of the openable end, the fingerprint lock comprising:

a housing with a removable front plate having a first opening for exposing a fingerprint identifying pad operably disposed in the housing and a second opening for receiving the locking loop of the pull tab therethrough;

a power operated mechanism having a moving pin operably disposed in the housing which actuates the pin between a closed position below the second opening to lock the locking loop through engagement between the pin and the aperture and an open position sufficiently disposed with respect to the second opening to not retain the locking loop when inserted through the second opening; and a controller operably disposed in the housing and connected to the fingerprint pad and power operated mechanism for closing the opening and closing the pin based on a preprogrammed fingerprint identification being met, wherein a width profile defined by the housing of the fingerprint lock is sized such that it occupies a substantial majority of the dimension of the second of the minor sides, while the width of the minor sides is less than the major sides such that the structural rigidity of the minor sides that is greater than the major sides coupled with the fingerprint lock occupying a substantial majority of the dimension of the second of the minor sides reduces exposure of the fingerprint lock to flexure-related damage thereto.

* * * * *